US006857408B2

(12) United States Patent
Yoshida et al.

(10) Patent No.: US 6,857,408 B2
(45) Date of Patent: Feb. 22, 2005

(54) INTERNAL COMBUSTION ENGINE PROVIDED WITH DECOMPRESSING MECHANISM

(75) Inventors: Hiroyuki Yoshida, Wako (JP); Tomonori Ikuma, Wako (JP); Mitsuharu Tanaka, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/357,830

(22) Filed: Feb. 4, 2003

(65) Prior Publication Data

US 2003/0145819 A1 Aug. 7, 2003

(30) Foreign Application Priority Data

Feb. 6, 2002 (JP) ..... 2002-029878
Apr. 8, 2002 (JP) ..... 2002-105702

(51) Int. Cl.[7] ..... F00L 13/08
(52) U.S. Cl. ..... 123/182.1
(58) Field of Search ..... 123/182.1

(56) References Cited

U.S. PATENT DOCUMENTS 3,314,408 A * 4/1967 Fenton ..... 123/182.1
3,395,689 A 8/1968 Kruse
4,453,507 A 6/1984 Braun et al.
5,687,683 A 11/1997 Knoblauch
5,957,101 A 9/1999 Schmitz et al.
2001/0023673 A1 9/2001 Suzuki et al.

FOREIGN PATENT DOCUMENTS

EP 0 515 183 A1 11/1992
JP 63-246404 10/1988
JP 11-294130 10/1999
JP 2000-227064 8/2000

* cited by examiner

*Primary Examiner*—Andrew M. Dolinar
(74) *Attorney, Agent, or Firm*—Carrier, Blackman & Associates, P.C.; Joseph P. Carrier; William D. Blackman

(57) ABSTRACT

A decompressing mechanism included in an internal combustion engine has a flyweight supported for swinging motion by a pin on the camshaft of the internal combustion engine, a decompression cam and an arm connecting the flyweight and the decompression cam and having the shape of a plate. The flyweight has a weight body and projections projecting from the weight body and engaged with the pin. The weight body is a block of a width along the axis of swinging motion and a thickness, along a radial direction, which are greater than the thickness, along the axis, of swinging motion of the arm. The weight body overlaps the camshaft as viewed from a direction perpendicular to a reference plane. The decompressing mechanism is small, lightweight and is capable of concentrating most of its mass on the flyweight.

26 Claims, 7 Drawing Sheets

INTERNAL COMBUSTION ENGINE PROVIDED WITH DECOMPRESSING MECHANISM

BACKGROUND OF THE INVENTION

1. Field of the Invention

The present invention relates to an internal combustion engine provided with a centrifugal decompressing means for reducing compression pressure to facilitate starting the internal combustion engine by opening a valve included in the internal combustion engine during the compression stroke in starting the internal combustion engine.

2. Description of the Related Art

Internal combustion engines provided with a centrifugal decompressing means including a flyweight are disclosed in JP2000-227064A and JP11-294130A. The decompressing means of those known techniques, which will be referred to as "prior art A", includes a lever provided with a weight and a decompression cam, and having the shape of a flat plate of a substantially uniform thickness. The lever is supported for turning at two parts thereof diametrically facing a camshaft by a pin on the camshaft. The decompression cam is connected to the weight by two arms extending from the two parts of the lever supported by the pin.

Centrifugal decompressing means of techniques disclosed in JP63-246406A and U.S. Pat. No. 3,395,689, which will be referred to as "prior art B", includes a lever provided with a weight and a decompression cam, and having the shape of a flat plate of a substantially uniform thickness. The lever is supported for turning at one part thereof by a pin on a camshaft. Therefore, the decompression cam is connected to the weight by a single arm extending from the one part of the lever supported by the pin. The weight capable of swinging on the pin relative to the camshaft overlaps the camshaft as viewed from a direction perpendicular to a plane including the axis of rotation of the camshaft and parallel to the axis of swinging motion or a to a plane including the axis of rotation of the camshaft and a plane including the axis of swinging motion.

According to the prior art A, the lever, which corresponds to a decompression member, has the two arms and hence the mass ratio of the weight to the lever is low. Therefore, it is difficult to concentrate a large part of the mass of the lever on the weight to generate a high centrifugal force necessary for stopping a decompressing operation at a set engine speed without increasing the weight of the lever. To generate a necessary centrifugal force, the size of the lever increases and the diameter of a cylindrical space in which the fully expanded lever revolves, around the camshaft increases, the layout of members in a valve gear chamber in which the camshaft is disposed is subject to restrictions, and the weight of the lever increases.

According to the prior art B, the lever corresponding to a decompression member is provided with the single arm. Therefore, the mass ratio of the weight to the lever of the decompressing means of the prior art B is greater than that of the weight to the lever of the decompressing means of the prior art A. However, since the thickness of the weight is equal to that of the arm, i.e., the thickness of a plate forming the lever, it is difficult to concentrate mass on the weight simultaneously with the reduction of the size of the decompressing means.

The lever needs to be bent or an additional member needs to be attached to the lever to concentrate mass on the weight included integrally with the lever formed from a plate of a uniform thickness. Thus the concentration of mass on the weight increases working steps, and requires difficult work because the lever has a complicated shape. Consequently, the respective operating characteristics of such complicated levers, i.e., decompression members, are distributed in a wide range.

The present invention has been made in view of such circumstances and it is therefore an object of the present invention to provide an internal combustion provided with a small lightweight decompressing mechanism including a flyweight on which most of the mass of the decompressing mechanism can be concentrated. Another object of the present invention is to provide a simple method of preventing a pin from coming off, to eliminate the connection of the projection of a flyweight and an arm, and to optimize the designs of the component part of a decompressing mechanism. A third object of the present invention is to facilitate the manufacture of a decompressing mechanism respectively having operating characteristics distributed in a narrow range.

SUMMARY OF THE INVENTION

According to the present invention, an internal combustion engine comprises a crankshaft, a camshaft driven for rotation in synchronism with the crankshaft, a valve-operating cam formed on the camshaft, engine valves operated for opening and closing by the valve-operating cam, and a decompressing mechanism for opening the engine valve in a compression stroke in a starting phase, wherein the decompressing mechanism comprises a flyweight supported for, swinging motion by a pin on the camshaft, a decompression cam that operates together with the flyweight to exert a valve-opening force on one of the engine valves, and an arm connecting the flyweight and the decompression cam, the flyweight has a weight body and projections projecting from the weight body and engaged with the pin, the pin is disposed such that the axis of swinging motion of the flyweight is included in a plane substantially perpendicular to the axis of rotation of the camshaft, the weight body is a block of width along the axis or swinging motion and a thickness along a radial direction which are greater than the thickness along the axis of swinging motion of the arm, and the weight body overlaps the camshaft as viewed from a direction perpendicular to a reference plane including the axis of rotation of the camshaft and parallel to the axis of swinging motion.

In the decompressing mechanism including the flyweight having the weight body and the projections engaged with the pin, and the arm, the mass ratio of the weight body to the decompressing mechanism is large. The weight body is formed in the width along the axis of swinging motion greater than the thickness of the arm, and in the thickness in the radial direction greater than the thickness of the arm to form the decompressing mechanism of component parts respectively having different thicknesses. Therefore, the flyweight has a necessary rigidity, the mass of the atm can be reduced to the least possible extent, most of the mass of the decompressing mechanism is concentrated on the weight body, and the weight body is disposed in a space radially inside the camshaft such that the weight body overlaps the camshaft as viewed from the direction perpendicular to the reference plane.

The decompressing mechanism thus formed has the following effects. Since the decompressing mechanism includes the flyweight having the weight body and the projections, and the arm, and the weight body has the width and the thickness which are greater than the thickness of the arm, the decompressing mechanism is lightweight and most of the mass of the decompressing mechanism can be concentrated on the weight body. The weight body overlapping the camshaft as viewed from the direction perpendicular to the reference plane suppresses the enlargement of the decompressing mechanism, and therefore the fully expanded decompressing mechanism is able to revolve around the camshaft in a small cylindrical space around the camshaft or the expansion of the cylindrical space can be suppressed.

The arm may have the shape of a plate, and the thickness of the arm may be equal to the thickness of a plate forming the arm. The arm may be extended from the flyweight in a plane perpendicular to the axis of swinging motion.

Preferably, the camshaft has a holding part including projections provided with first holes, respectively, the projections of the flyweight are provided with second holes, respectively, the pin is inserted in the first holes so as to be turnable therein and is inserted in the second holes to support the flyweight for tog, and an end pant projecting outside from one of the first or the second holes is pressed to form an expanded part for preventing the pin from coming off the first and the second holes.

Thus, the following effect is produced. The pin can be prevented from coming off the first and the second holes simply by pressing the end part thereof.

The arm may be extended from the weight body. Since the projections through which the pin is inserted, and the arm connecting the flyweight and the decompression cam can be thus extended in different directions, respectively, from the weight body, the thicknesses and the shapes of the projections and the arm can be individually determined, and the optimum designing of the positional relation or the flyweight and the arm with the camshaft, the projections, the weight body and the arm is possible.

The flyweight, the decompression cam and the arm can be formed integrally in a single structure by metal injection.

Although the decompressing mechanism is formed by integrally combining the component parts respectively having different thicknesses, the flyweight, the decompression cam and the arm can be formed in high dimensional accuracy. Since the flyweight, the decompression cam and the arm respectively having different thicknesses are formed integrally in high dimensional accuracy, the decompressing mechanism has an operating characteristic in a narrow range around a reference operating characteristic, and the decompressing mechanism capable of exhibiting a stable operating characteristic can be easily manufactured.

According to one aspect of the present invention, the crankshaft has a vertical axis of rotation, a cut part for receiving the flyweight therein is formed in the outer surface of the camshaft, and the decompressing mechanism includes a return spring that exerts resilient force on the flyweight received in the cut part to hold the flyweight at an initial position.

A second cut for receiving the arm connecting the flyweight and the compression cam, and the decompression cam therein may be formed in the outer surface of the camshaft, and the arm may be provided with a contact protrusion that rests on the camshaft to locate the flyweight at a full-expansion position.

The second cut part may be provided with a step with which the arm comes into contact. Desirably, the second cut part has a bottom surface along which the arm slides when the flyweight swings.

In this specification, the expression 'substantially perpendicular' is used for expressing both an exactly perpendicularly intersecting condition and an approximately perpendicularly intersecting condition. Terms, 'diametrical direction' and 'circumferential direction' signify a direction parallel to a diameter of the camshaft and a direction along the outer surface of the camshaft, respectively, unless otherwise specified.

DESCRIPTION OF THE PREFERRED EMBODIMENTS

An internal combustion engine provided with decompressing mechanisms in a preferred embodiment of the present invention will be described with reference to the accompanying drawings.

Figure 1:
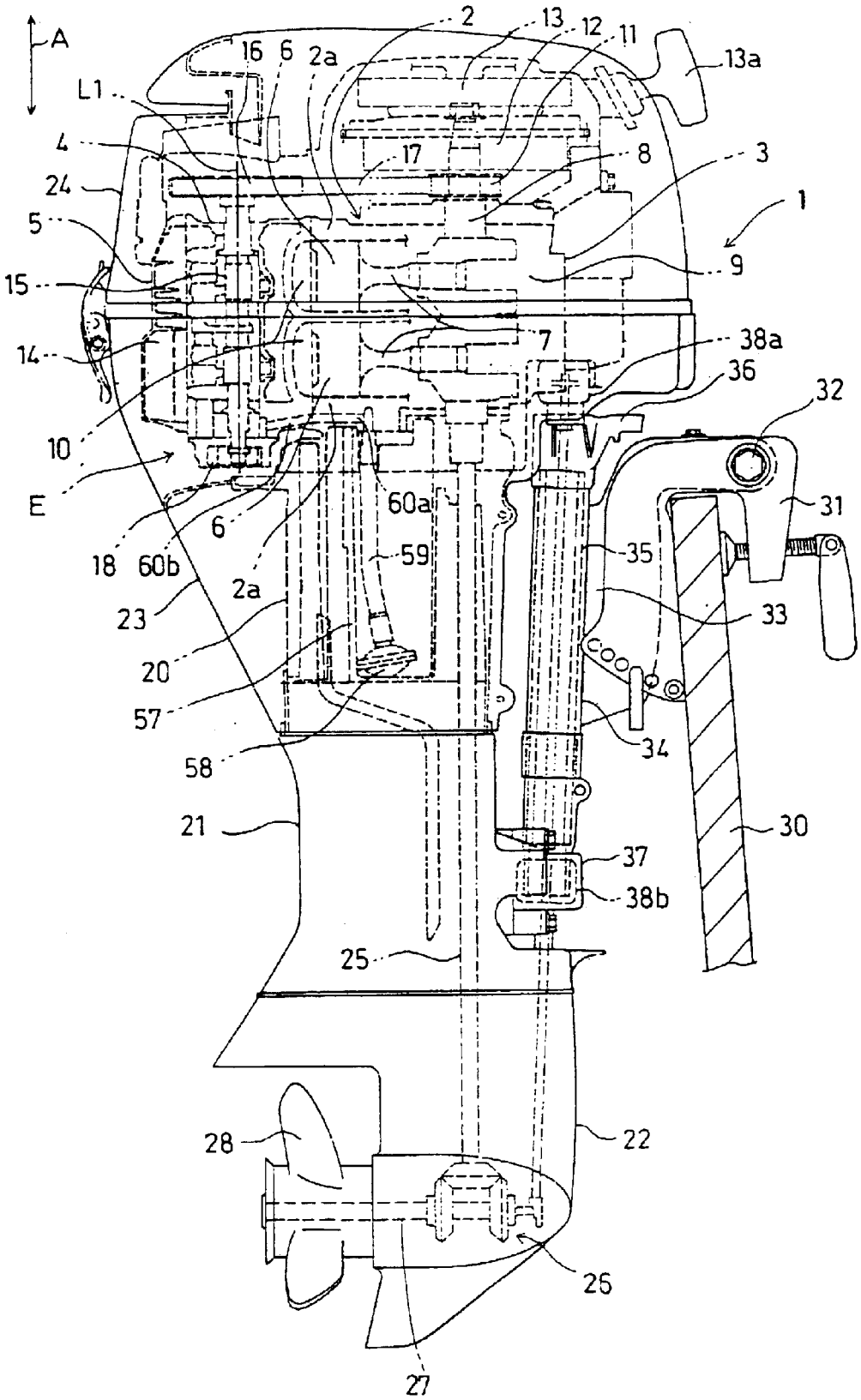
FIG. 1 is a schematic side elevation of an outboard motor including an internal combustion engine provided with a decompressing mechanism in a preferred embodiment according to the present invention, as viewed from the right-hand side of the outboard motor.

Referring to FIG. 1, an internal combustion engine E provided with decompressing mechanisms D according to the present invention is a water-cooled, inline, two-cylinder, four-stroke-cycle, vertical internal combustion engine installed in an outboard motor with the axis of rotation of its crankshaft 8 vertically extended. The internal combustion engine E comprises a cylinder block 2 provided with two cylinder bores 2*a* in a vertical, parallel arrangement with their axes longitudinally horizontally extended, a crankcase 3 joined to the front end of the cylinder block 2; a cylinder head 4 joined to the rear end of the cylinder block 2; and a cylinder head cover joined to the rear end of the cylinder head 4. The cylinder block 2, the crankcase 3, the cylinder head 4 and the cylinder head cover 5 constitute an engine body.

A piston 6 is fitted for reciprocating sliding motions in each of the cylinder bores 2*a* and is connected to a crankshaft 8 by a connecting rod 7. The crankshaft 8 is installed in a crank chamber 9 and is supported for rotation in upper and lower plain bearings on the cylinder block 2 and the crankcase 3. The crankshaft 8 is driven for rotation by the pistons 6 driven by combustion pressure produced by the combustion of an air-fuel mixture ignited by spark plugs.

The phase difference between the pistons 6 fitted in the two cylinder bores 2*a* corresponds to a crank angle of 360°. Therefore, combustion occurs alternately in the cylinder bores 2*a* at equal angular intervals in this internal combustion engine E. A crankshaft pulley 11 and a rewind starter 13 are mounted in that order on an upper end part of the crankshaft 8 projecting upward from the crank chamber 9.

Figure 2:
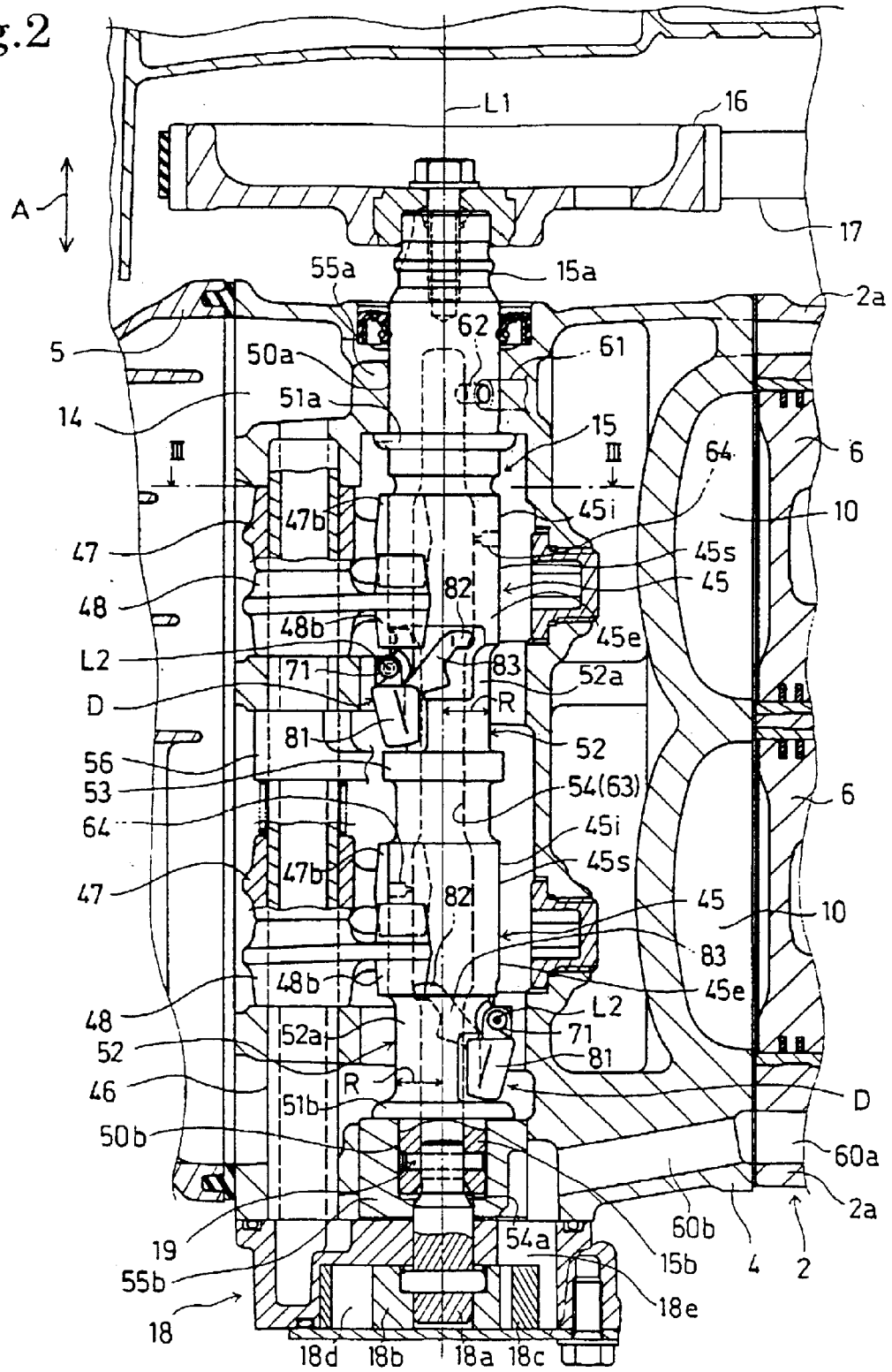
FIG. 2 is a longitudinal sectional view of a part, around a cylinder head, of the internal combustion shown in FIG. 1.

Referring to FIGS. 1 and 2, a camshaft 15 is installed in a valve gear chamber 14 defined by the cylinder head 4 and the cylinder head cover 5 and is supported for rotation on the cylinder head 4 with its axis L1 of rotation extended in parallel with that of the crankshaft 8. A camshaft pulley 16 is mounted on an upper end part 15*a* of the camshaft 15 projecting upward from the valve gear chamber 14. The camshaft 15 is driven for rotation in synchronism with the crankshaft 8 at a rotating speed equal to half that of the crankshaft 8 by the crankshaft a through a transmission mechanism including the crankshaft pulley 11, the camshaft pulley 16 and a timing belt 17 extended between the pulleys 11 and 16. A lower end part 15*b* of the camshaft 15 is coupled by a shaft coupling 19 with a pump drive shaft 18*a* connected to the inner rotor 18*b* of a trochoid oil pump 18 attached to the lower end wall of the cylinder head 4.

As shown in FIG. 1, the engine body is joined to the upper end of a support block 20. An extension case 21 has an upper end joined to the lower end of the support block 20 and a lower end joined to a gear case 22. An under cover 23 joined to the upper end of the extension case 21 covers a lower half part of the engine body and the support block 20. An engine cover 24 joined to the upper end of the under cover 23 covers an upper half part of the engine body.

A drive shaft 25 connected to a lower end part of the crankshaft 8 extends downward through the support block 20 and the extension case 21, and is connected to a propeller shaft 27 by a propelling direction switching device 26 including a bevel gear mechanism and a clutch mechanism. The power of the internal combustion engine E is transmitted through the crankshaft 8, the drive shaft 25, a propelling direction switching device 26 and the propeller shaft 27 to a propeller 28 fixedly mounted on a rear end part of the propeller shaft 27 to drive the propeller 28 for rotation.

The outboard motor 1 is detachably connected to a hull 30 by a transom clamp 31. A swing arm 33 is supported for swing motions in a vertical plane by a tilt shaft 32 on the transom clamp 31. A tubular swivel case 34 is connected to the rear end of the swing arm 33. A swivel shaft 35 fitted for rotation in the swivel case 34 has an upper end part provided with a mounting frame 36 and a lower end part provided with a center housing 37. Tec mounting frame 36 is connected elastically through a rubber mount 38*a* to the support block 20. The center housing 37 is connected elastically through a rubber mount 38*b* to the extension case 21. A steering arm, not shown, is connected to the front end of the mounting frame 36. The steering arm is turned in a horizontal plane for controlling the direction of the outboard motor 1.

Further description of the internal combustion engine E will be made with reference to FIGS. 2 and 3. An intake port 40 through which an air-fuel mixture prepared by a carburetor, not shown, flows into a combustion chamber 10 and an exhaust port 41 through which combustion gases discharged from the combustion chamber 10 flows are formed for each of the cylinder bores 2*a* in the cylinder head 4. An intake valve 42 that opens and closes the intake port 40 and an exhaust valve 43 that opens and closes the exhaust port 41 are urged always in a closing direction by the resilience of valve springs 44. The intake valve 42 and the exhaust valve 43 are operated for opening and closing operations by a valve train installed in the valve gear chamber 14. The valve train includes the camshaft 15, valve-operating cams 45 formed on the camshaft 15 so as to correspond to the cylinder bores 2*a*, intake rocker arms (cam followers) 47 mounted for rocking motion on a rocker shaft 46 fixedly supported on the cylinder head 4 and driven by the valve-operating cams 45, and exhaust rocker arms (cam followers) 48 mounted on the rocker shaft 46 and driven by the valve-operating cams 45.

Each valve-operating cam 45 has an intake cam part 45*i*, an exhaust earn part 45*e*, and a cam surface 45*s* common to the intake cam part 45*i* and the exhaust cam part 45*c*. The intake rocker arm 47 has one end part provided with an adjusting screw 47*a* in contact with the intake valve 42 and the other end provided with a slipper 47*b* in contact with the cam surface 45*s* of the intake cam part 45*i* of the valve-operating cam 45. The exhaust rocker arm 48 has one end provided with an adjusting screw 48*a* in contact with the exhaust valve 43 and the other end provided with a slipper 48*b* in contact with the cam surface 45*s* of the exhaust cam part 45*c* of the valve-operating cam 45. The cam surface 45*s* of the valve-operating cam 45 has a heel 45*a* of a shape conforming to a base circle for keeping the intake valve 42 and the exhaust valve 43 closed, and a toe 45*b* that times the operation of the intake valve 42 and the exhaust valve 43 and determines the lift of the intake valve 42 and the exhaust valve 43. The valve-operating cams 45 rotate together with the camshaft 15 to rock the intake rocker arms 47 and the exhaust rocker arms 48 to operate the intake valves 42 and the exhaust valves 43.

As shown in FIG. 2, the camshaft 15 has the pair of valve-operating cams 45, an upper journal 50*a*, a lower journal 50*b*, an upper thrust-bearing part 51*a* continuous with the upper journal 50*a*, a lower thrust-bearing part 51*b* continuous with the lower journal 50*b*, shaft parts 52 extending between the valve-operating cams 45 and between the valve-operating cam 45 and the lower thrust-bearing part 51*b*, and a pump-driving cam 53 for driving a fuel pump, not shown. The camshaft 15 has a central bore 54 having an open lower end opening in the end surface of the lower end part 15*b* in which the lower journal 50*b* is formed, and a closed upper end in the upper journal 50*a*. The bore 54 extends vertically in the direction of the arrow A parallel with the axis of rotation of the camshaft 15.

The upper journal 50*a* is supported for rotation in an upper bearing 55*a* held in the upper wall of the cylinder head 4, and a lower journal 55*b* is supported for rotation in a lower bearing 55*b* held in the lower wall of the cylinder head 4. Each shaft part 52 has a cylindrical surface 52*a* having the shape of a circular cylinder of a radius R smaller than the radius of the heel 45*a* of a shape conforming to the base circle. The pump-diving cam 53 is formed on the shaft part 52. The pump-driving cam 53 drives a drive arm 56 supported for swinging on the rocker shaft 46 for swinging motion to reciprocate the drive rod included in the fuel pump in contact with the drive arm 56.

A lubricating system will be described. Referring to FIG. 1, an oil pan 57 is formed in the support block 20. A lower end provided with an oil strainer 58 of a suction pipe 59 is immersed in a lubricating oil contained in the oil pan 57. The suction pipe 59 has an upper end connected by a joint to an oil passage 60*a* formed in the cylinder block 2. The oil passage a communicates with the suction port 18*e* (FIG. 2) of the oil pump 18 by means of an oil passage 60*b* formed in the cylinder head 4.

The discharge port, not shown, of the oil pump 18 is connected through oil passages, not shown, formed in the cylinder head 4 and the cylinder block 2, and an oil filter, not shown, to a main oil passage, not shown, formed in the cylinder block 2. A plurality of branch oil passages branch from the main oil passage. The branch oil passages ate connected to the bearings and sliding parts including the plain bearing supporting the crankshaft 8 of the internal combustion engine E. One branch oil passage 61 among the plurality of branch oil passages is formed in the cylinder head 4 to supply the lubricating oil to the sliding parts of the valve train and the decompressing mechanisms D in the valve gear chamber 14 as shown in FIG. 2.

The oil pump 18 sucks the lubricating oil into a pump chamber 18*d* formed between an inner rotor 18*b* and an outer rotor 18*e* trough the oil strainer 58, the suction pipe 59, and the oil passages 60*a* and 60*b* from the oil pan 57. The high-pressure lubricating oil discharged from the pump chamber 18*d* flows through the discharge port, the oil filter, the main oil passage and the plurality of branch passages including the branch passage 61 to the sliding parts.

Part of the lubricating oil flowing through the oil passage 61 opening into the bearing surface of the upper bearing 55*a* flows through an oil passage 62 formed in the upper journal 50*a* and opening into the bore 54. The oil passage 62 communicates intermittently with the oil passage 61 once every one turn of the camshaft 15 to supply the lubricating oil into the bore 54. The bore 54 serves as an oil passage 63. The lubricating oil supplied into the oil passage 63 flows through oil passages 64 opening in the cam surfaces 45*s* of the valve-operating cams 45 to lubricate the sliding surfaces of the slippers 47*a* of the intake rocker arms 47 and the valve-operating cams 45 and to lubricate the sliding surfaces of the slippers 48*b* of the exhaust rocker arms 48 and the valve-operating cams 45. The rest of the lubricating oil flowing through the oil passage 63 flows out of the oil passage 63 through an opening 54*a* to lubricate the sliding parts of the lower bearing 55*b* and the lower journal 50*b*, and the sliding parts of the lower thrust-bearing part 51*b* and the lower bearing 55*b*, and flows into the valve gear chamber 14. The oil passages 64 do not need to be formed necessarily in parts shown in FIG. 2; the oil passages 64 may be formed, for example, in parts opposite to the toes 45*b* of the valve-operating cams 45 across the axis L1 of rotation.

The rest of the lubricating oil flowing through the oil passage 61 flows through a small gap between the upper journal 50*a* and the upper bearing 55*a* to lubricate the sliding parts of the thrust-bearing part 51*a* and the upper bearing 55*a*, flows into the valve gear chamber 14. The lubricating oil, which flows through the oil passages 61 and 64 into the valve gear chamber 14, lubricates the sliding parts of the intake rocker arms 47, the exhaust rocker arms 48, the drive arm, and the rocker shaft 46. Eventually, the lubricating oil flowing through the oil passage 61 drops or flows down to the bottom of the valve gear chamber 14, and flows through return passages, not shown, formed in the cylinder head 4 and the cylinder block 2 to the oil pan 57.

Figure 3:
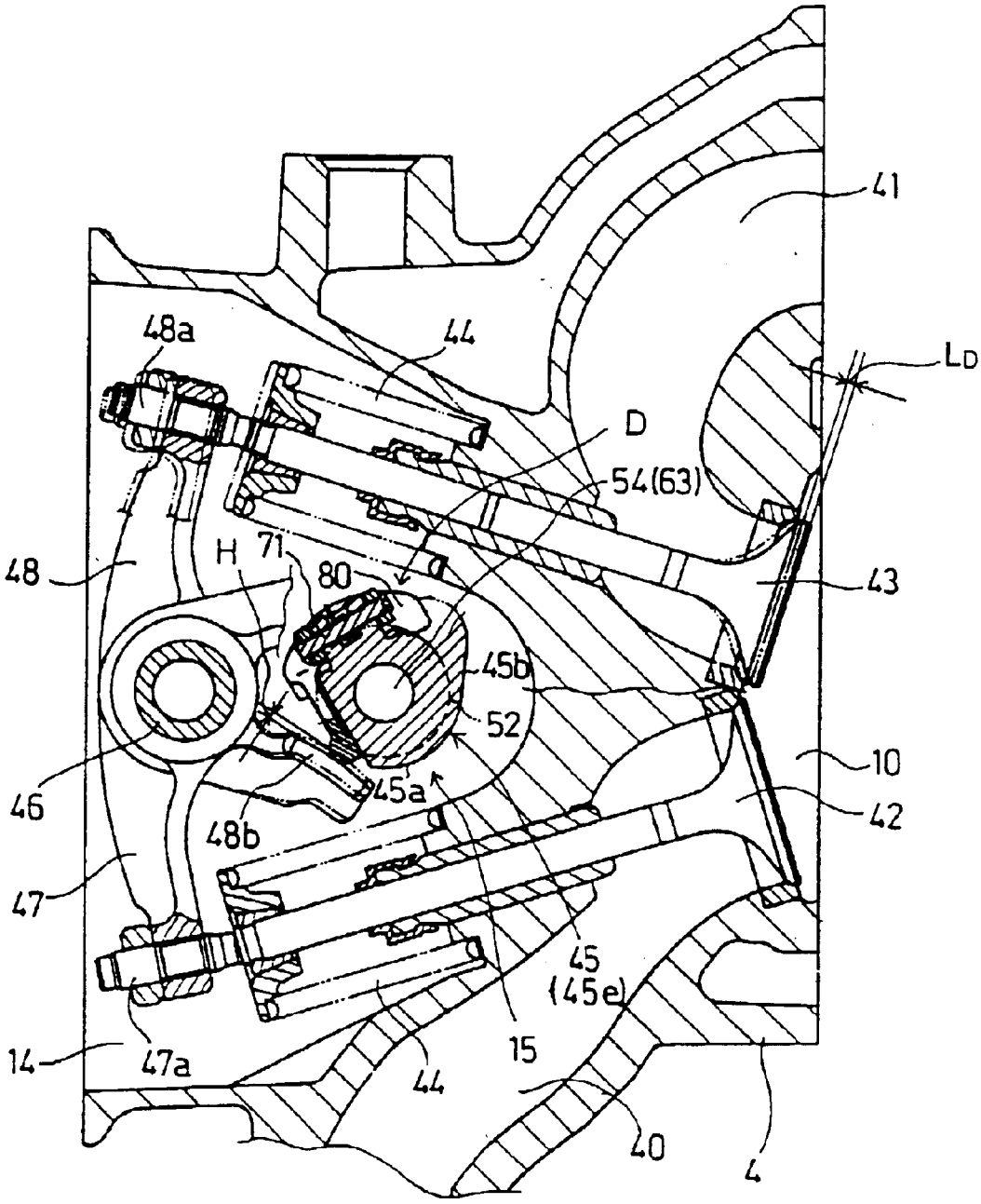
FIG. 3 is a sectional view taken on line III—III in FIG. 2, corresponding to a sectional view in a plane including the axes of an intake valve and an exhaust valve with the cylinder head and to a sectional view similar to FIG. 4 with a camshaft.

As shown in FIGS. 2 and 3, the decompressing mechanisms D, which perform a decompressing operation to reduce force necessary for operating the rewind starter 13 in starting the internal combustion engine A, are combined with the camshaft 15. The decompressing mechanisms D correspond to the cylinder bores 2*a*, respectively. Th decompressing mechanisms D perform a decompressing operation to reduce force necessary for operating the rewind starter 13 in starting the internal combustion engine E. Each decompressing mechanism D causes the corresponding cylinder bore 2*a* to discharge the gas contained therein in a compression stroke through the exhaust port 41 to decompress the cylinder bore 2*a*. The decompressing mechanisms D are identical and the difference in phase between the decompressing mechanisms D is equal to a cam angle of 180° corresponding to a crank angle of 360°.

Figure 4:
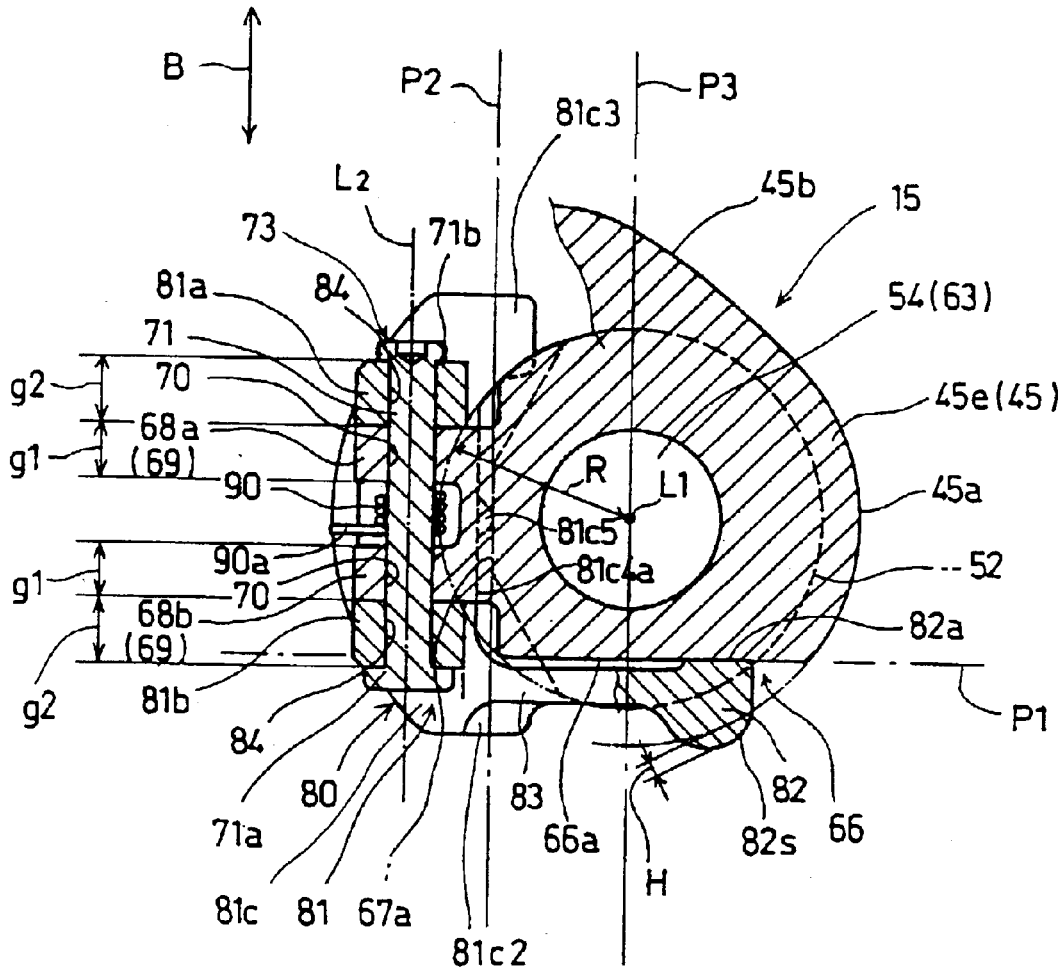
FIG. 4 is a sectional view taken on line IV—IV in FIG. 7A.
Figure 5:
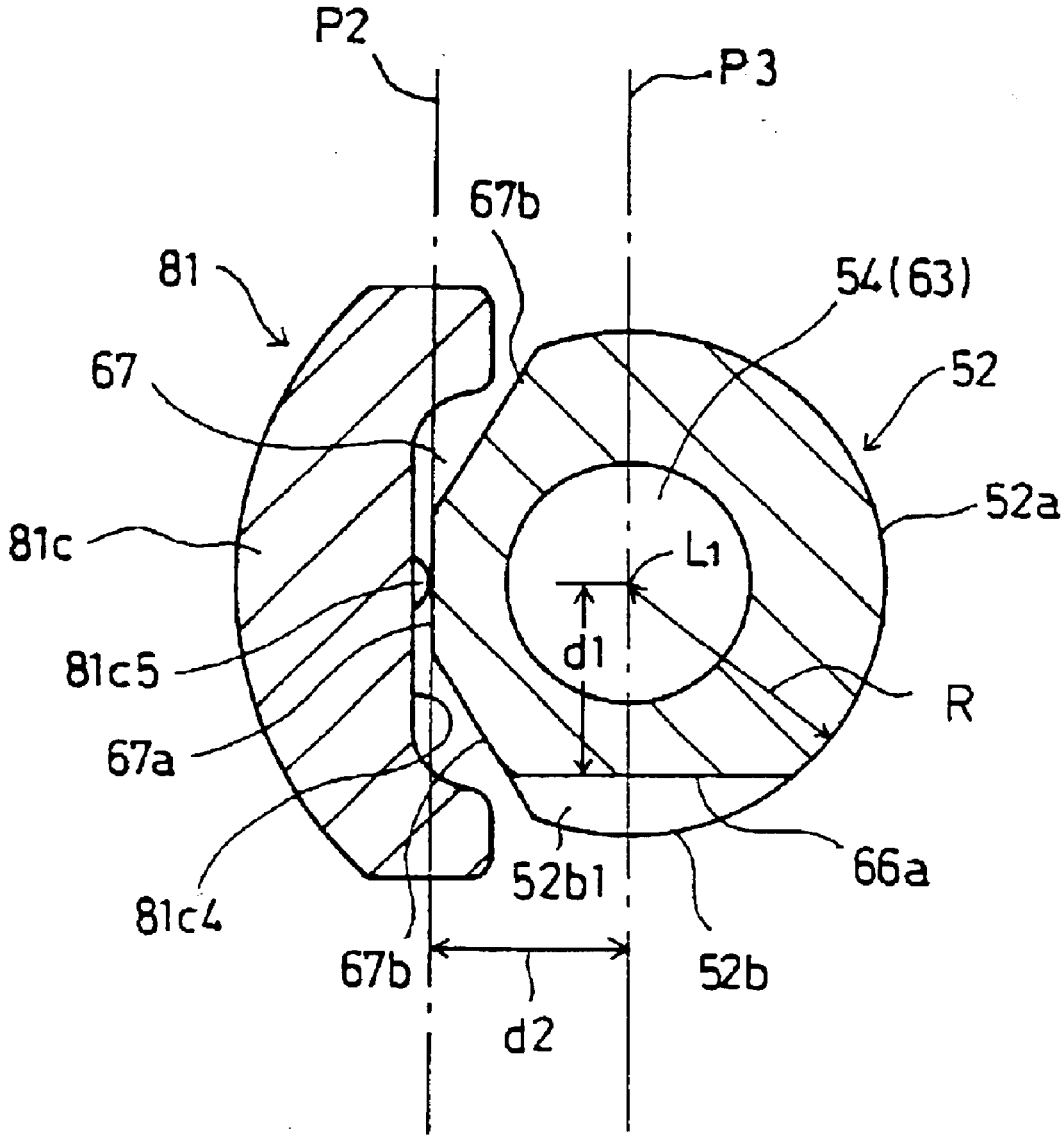
FIG. 5 is a sectional view taken on line V—V in FIG. 7A.
Figure 7A:
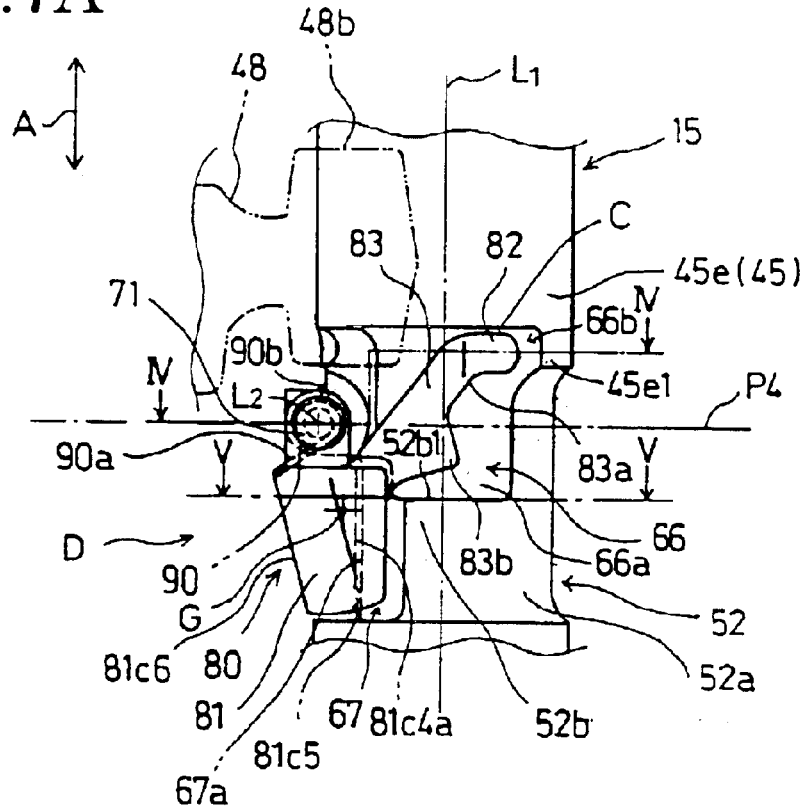
FIG. 7A is a view of the decompressing mechanism at an initial position.

Referring to FIGS. 4, 5 and 7A, each decompressing mechanism D is formed on the shaft part 52 contiguous with the exhaust cam part 45*e* in contact with the slipper 49*b* of the exhaust rocker arm 48 of the valve-operating cam 45. As shown in FIG. 7A, a cut part 66 is formed between a lower end part 45*e*1 contiguous with the shaft part 52 of the exhaust cam part 45*e*, and the shaft part 52 below the lower end part 45*e*1. The out part 66 has a bottom surface 66*a* included in a plane P1 (FIG. 4) perpendicular to an axis 12 of swinging motion. A cut part 67 is formed in the shaft part 52 so as to extend downward from a position overlapping the cut part 66 with respect to the direction of the arrow A parallel to the axis of rotation. The cut part 67 has a middle bottom surface 67*a* included in a plane P2 perpendicular to the plane P1 and parallel to the axis L1 of rotation, and a pair of end bottom surfaces 67*b* (FIG. 5) inclined to the middle bottom surface 67*a* and parallel to the axis L1 of rotation.

More concretely, the cut part 66 is formed by cutting a part of the lower end part 45*e*1 of the exhaust cam part 45*e* and a part near the exhaust cam part 45*e* of the shaft part 52 such that the distance d1 (FIG. 5) between the axis L1 of rotation of the bottom surface 66*a* is smaller than the radius R of the cylindrical surface 52*a*, and the bottom surface 66*a* is nearer to the axis L1 of rotation than the surface of the shaft part 52. The cut part 67 is formed by cutting part of the shaft part 52 such that the distance d2 (FIG. 5) between the middle bottom surface 67*a* and a reference plane P3 including the axis L1 of rotation and parallel to the axis 12 of swinging motion is smaller than the radius R of the cylindrical surface 52*a*, and the middle bottom surface 67*a* is nearer to the axis L1 of rotation than the surface of the shaft part 52.

As shown in FIG. 4, a holding part 69 is formed above the cut part 67 in the shaft part 52. The holding part 69 has a pair of projections 68*a* and 68*b* radially outwardly projecting from the shaft past 52 in parallel to the plane P1. The projections 68*a* and 68*b* are provided with holes 70, and a cylindrical pin 71 are fitted in the holes 70 of the arms 68*a* and 68*b*, and a flyweight 81 is supported by the pin 71 for swinging motion relative to the camshaft 15. The projections 68*a* and 68*b* are spaced a distance apart in the direction of the axis of the pin 71 and are formed integrally with the camshaft 15.

Figure 6A:
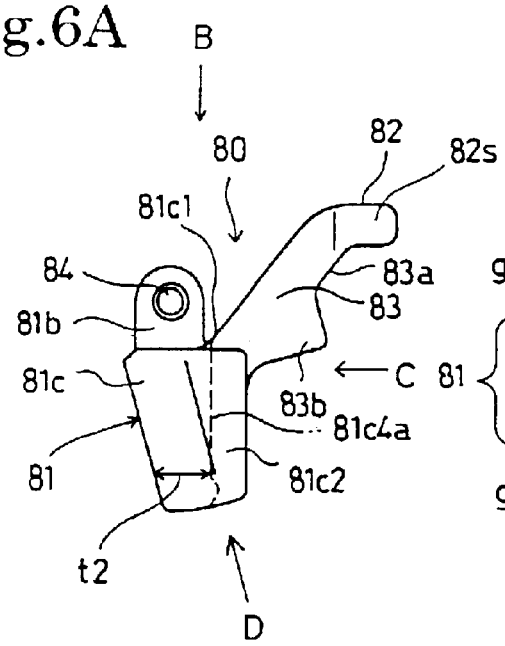
FIG. 6A is a side elevation of a decompression member included in the decompressing mechanism shown in FIG. 1.
Figure 6B:
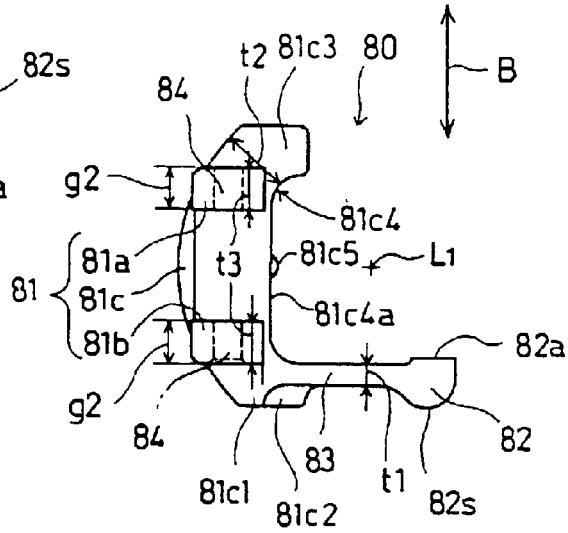
FIG. 6B is a view take in the direction of the arrow B in FIG. 6A.
Figure 6C:
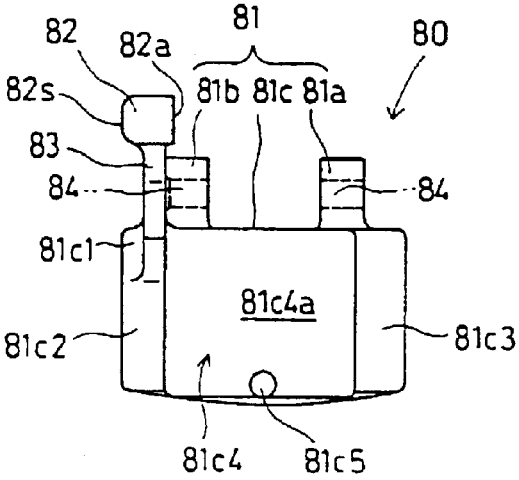
FIG. 6C is a view take in the direction of the arrow C in FIG. 6A.

Referring to FIGS. 6A to 6C, each decompressing mechanism D includes a decompression member 80 of a metal, such as an iron alloy containing 15% nickel, and a return spring 90. The return spring 90 is a torsion coil spring. The decompression member 80 has the flyweight 81 supported for turning by the pin 71 on the holding part 69, a decompression cam 82 that swings together with the flyweight 81, comes into contact with the slipper 48*b* of the exhaust rocker arm 48 in a starting phase of the internal combustion engine E to exert a valve opening force on the exhaust valve 43, and a flat arm 83 connecting the flyweight 81 and the decompression cam 82. The decompression member 80 is a molding integrally including the flyweight 81, the decompression cam 82 and the arm 83 and may be formed by metal injection. Metal injection is a forming process including steps of forming a molding of metal powder by injection molding, and sintering the molding.

The return spring 90 extended between the pair of projections 68*a* and 68*b* has one end 90*a* engaged with the flyweight 81, and the other end 90*b* (FIG. 7A) engaged with the projection 68*a*. The resilience of the return sing 90 is adjusted so that it generates a torque capable of holding the flyweight 81 at an initial position shown in FIG. 7A while the engine speed is below a predetermined engine speed.

Figure 6D:
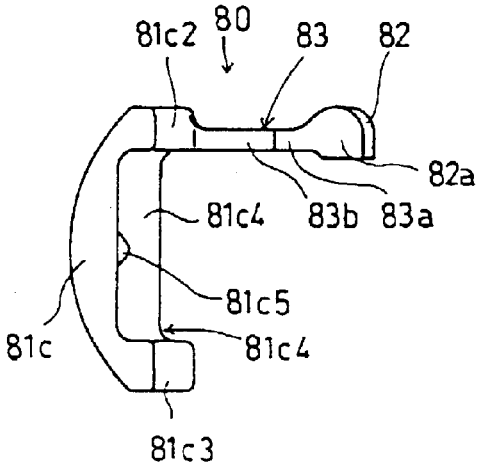
FIG. 6D is a view take in the direction of the arrow D in FIG. 6A.

The flyweight 81 has a weight body 81*c*, and a pair of flat projections 81*a* and 81*b* projecting from the weight body 81*c* in a direction parallel to the axis L2 of swinging motion (hereinafter referred to as "the direction of the arrow B") and lying on the outer side of the projections 68*a* and 68*b*, respectively. The projections 81*a* and 81*b* extend from the weight body 81*c* toward the pin 71. The projections 81*a* and 81*b* have a thickness t3, i.e., thickness along the direction of the arrow B as viewed in FIG. 6B, slightly greater than the thickness t1 of the arm 83 and smaller than the thickness t2 of the weight body 81*c* of the flyweight 81 shown in FIG. 6D by way of example. The projections 81*a* and 81*b* are provided with holes 84 of a diameter equal to that of the holes 70. The pin 71 is fitted in the holes 70 and 84 so as to be tamable therein.

The length g2 of the holes 84 along the direction of the arrow B (or the thickness of the projections 81*a* and 81*b*) is greater than the length g1 of the holes 70 along the direction of the arrow B (or the thickness of the projections 68*a* and 68*b*). Therefore, the sum of the lengths, of the holes 84 (or the sum of the thicknesses of the projections 81*a* and 81*b*) is greater than the sum of the lengths of the holes 70 (or the sum of the thicknesses of the projections 68*a* and 68*b*). Therefore, the area of parts of the surface of the pin 71 in contact with the projections 81*a* and 81*b* of the pin 71 is greater than that of parts of the surface 71 in contact with the holding part 69. As shown in FIG. 4, both the projections 68*a* and 68*b* and both the projections 81*a* and 81*b* lie in a range narrower than the outside diameter of the shaft part 52 of the camshaft 15 with respect to the direction of the arrow B.

Thus, in supporting the flyweight 81 on the camshaft 15, the holes 84 of the projections 81*a* and 81*b*, the holes 70 of the projections 68*a* and 68*b* and the return spring 90 are aligned, and then the pin 71 provided with a bead 71*a* is inserted from the side of the projection 81*b* in the holes 84 and 70 through the return spring 90. An end part 71*b* of the pin 71 projecting from the other projection 81*a*, i.e., an end part 71*b* extending outside the hole 84 of the projection 81*a*, is pressed to form an expanded part 73, so that the pin 71 is held in the holes 84 and 70. Thus, the decompression member 80 including the flyweight 81 is supported for swinging motion on the camshaft 5. When the decompression member 80 swings, the pin 71 turns together with the decompression member 80 in the holes 70 of the holding past 69.

The axis L2 of swinging motion aligned with the axis of the pin 71 is included in a plane P4 (FIGS. 7A and 7B) substantially perpendicular to the axis L1 of rotation of the camshaft 15 and does not intersect the axis L1 of rotation and the bore 54. In this embodiment, the axis L2 of swinging motion is at a distance greater than the radius R of the shaft part 52 from the axis L1 of rotation or the reference plane P3 as shown in FIG. 4. Therefore, the holding part 69 having the projections 68*a* and 68*b* is able to set the axis L2 of swinging motion at a distance greater than the radius R of the shaft part 52 from the reference plane P3. Consequently, the pin 71 does not intersect the axis L1 of rotation and the bore 54, and is separated diametrically from the axis L1 of rotation and the bore 54.

As best shown in FIGS. 4 and 6, the weight body 81*c* of the flyweight 81 has a thickness t2 along a diametrical direction greater than the thickness t1 of the arm 83 along a diametrical direction. The weight body 81*c* of the flyweight 81 has a thickness t2 in a diametrical direction greater than the thickness t3 of the projections 81*a* and 81*b* and the thickness t1 of the arm 83. The weight body 81*c* has a width (FIG. 4) along the direction of the arrow B greater than the thickness t3 of the projections 81*a* and 81*b* and the thickness t1 of the arm 83. The maximum width of the weight body 81*c* is approximately equal to the diameter including the heel 45*a* of the valve-operating cam 45.

The weight body 81*c* extends from the joint 81*c*1 of the flyweight 81 and the arm 83 on the side of the axis L1 of rotation with respect to the arm 83 along the axis L2 of swinging motion to a position on the opposite side of the arm 83 with respect to the axis L1 of rotation, and has opposite end parts 81*c*2 and 81*c*3 with respect to the axis L2 of swinging motion extending nearer to the reference plane P3 than the middle bottom surface 67*a* of the cut part 67. When the decompression member 80 is at the initial position, the outer surface 81*c*6 of the weight body 81*c* extends radially inward with distance from the pin 71 toward the direction of the arrow A. In this embodiment, the outer surface 81*c*6 extends so as to approach radially the shaft part 52 with downward distance.

The arm 83 projecting from the weight body 81*c* in a direction different from a direction in which the projections 81*a* and 81*b* extend, extends beyond the axis L1 of rotation as viewed from the direction of the arrow B (FIG. 7A), is received in the cut part 66 when the decompression member 80 is at the initial position, and extends along the bottom surface 66*a* on the side of one end part 81*c*2 of the weight body 81*c*. The arm 83 having the thickness t1 along the direction of the arrow B is formed in a length such that the decompression cam 82 does not project from the share part 52 of the camshaft 15 in a direction perpendicular to the reference plane P3 as viewed in the direction of the arrow B.

Figure 7B:
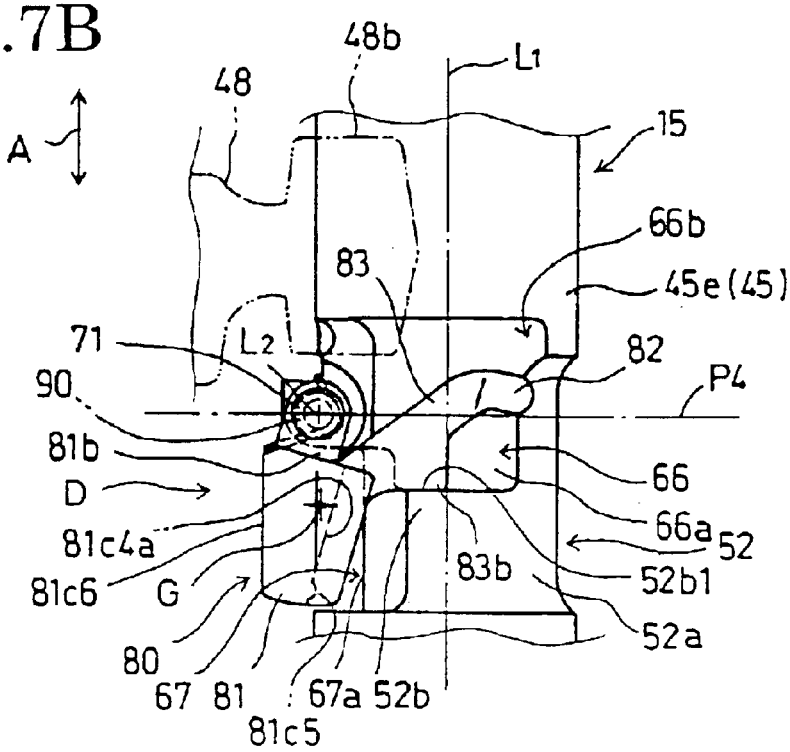
FIG. 7B is a view of the decompressing mechanism at a full-expansion position.

Referring to FIGS. 7A and 7B, a contact protrusion 81*c*5 is formed in a flat part 81*c*4*a* of the inner surface 81*c*4 (FIG. 6D), facing the camshaft 15, of the weight body 81*c*. The contact protrusion 81*c*5 rests on the middle bottom surface 67*a* of the cut part 67 when the flyweight 81 (or the decompression member 80) is set at the initial position. When the decompression member 80 is at the initial position, a gap C (FIG. 7A) is formed between the decompression cam 82 and the valve-operating cam 45 with respect to the direction of the arrow A. A contact protrusion 83*b* (FIG. 6A) is formed on the flat lower end surface, i.e., a side surface along the direction of the arrow A, of the arm 83. The contact protrusion 83*b* rests on the upper surface 52*b*1 of a step 52*b* (FIG. 7A) adjacent to the bottom surface 66*a* and forming the lower side wall of the cut part 66 to determine a full-expansion position for the radially outward swinging motion of the flyweight 81 (or the decompression member 80).

In an initial state where the decompression cam 82 is separated from the slipper 48*b* and the camshaft 15 is stopped, the contact protrusion 81*c*5 is in contact with the middle bottom surface 67*a* (FIG. 5) and the flyweight 81 (or the decompression member 80) stays at the initial position with a part thereof lying in the cut part 67 until the internal combustion engine E is started, the camshaft 15 is rotated and a torque acting about the axis L2 of swinging motion and produced by centrifugal force acting on the decompression member 80 increases beyond an opposite torque produced by the resilience of the return spring 90. When the slipper 48*b* is in contact with the decompression cam 82, the flyweight 81 is restrained from swinging by frictional force acting between the decompression cam 82 and the slipper 48*b* pressed by the resilience of the valve spring 44 against the decompression cam 82 even if the torque produced by the centrifugal force exceeds the opposite torque produced by the resilience of the return spring 90.

When the decompression member 80 is at the initial position, the distance between a flat part 81*c*4*a* (FIG. 6B) farthest from the reference plane P3 of the inner surface 81*c*4 and the reference plane P3 is shorter than the radius R of the cylindrical surface 52*a* as shown in FIG. 4. The center G of gravity (FIG. 7A) of the decompression member 80 is always below the axis L2 of swinging motion, i.e., at a position near the reference plane P3, when the decompression member 80 swings in a maximum range of swinging motion between the initial position and the full-expansion position, and is slightly on the side of the reference plane P3 with respect to a vertical line crossing the axis L2 of swinging motion when the decompression member 80 is at the initial position. Thus, the flyweight 81 approaches the reference plane P3 or the axis L1 of rotation when the flyweight 81 is turned to the full-expansion position. Furthermore, the pin 71 and the weight body 81*c* are disposed such that the pin 71 and the weight body 81*c* always overlap each other, as viewed in the direction of the arrow A, in the maximum range of swinging motion.

The decompression cam 82 formed at the extremity of the arm 83 has a cam lobe 82*s* (FIG. 4) protruding in the direction of the axis L2 of swinging motion, and a contact surface 82*a* on the opposite side of the cam lobe 82*s*. The contact surface 82*a* is in contact with the bottom surface 66*a* and slides along the bottom surface 66*a* when the arm 83 swings together with the flyweight 81. When the decompression member 80 is at the initial position, i.e., when the decompression member 80 is in the decompressing operation, the decompression cam 82 is on the opposite side of the axis L2 of swinging motion and the flyweight 81 with respect to the reference plane P3, is received in an upper part 66*b* (FIG. 7A), contiguous with the exhaust cam part, of the cut part 66, does not project from the shaft part 52 of the camshaft 15 in a direction perpendicular to the reference plane P3, as viewed in the direction of the arrow B, and projects radially by a predetermined maximum height H (FIGS. 3 and 4) from the heel 45*a* included in the base circle of the valve-operating cam 45. The predetermined height H defines a decompression lift $L_D$ (FIG. 3) by which the exhaust valve 43 is lifted up for decompression.

While the decompression cam 82 is in contact with the slipper 48*b* of the exhaust rocker arm 48 to open the exhaust valve 43, load placed by the resilience of the valve spring 44 on through the exhaust rocker arm 48 on the decompression cam 82 is born by the bottom surface 66*a*. Consequently, load that is exerted on the arm 83 by the exhaust rocker arm 48 during the decompressing operation is reduced and hence the thickness t1 of the arm 83 may be small.

The operation and effect of the embodiment will be described.

While the internal combustion engine E is stopped and the camshaft 51 is not rotating, the center G of gravity of the decompression member 80 is on the side of the reference plane P3 with respect to the axis L2 of swinging motion, and the decompression member 80 is in an initial state where a clockwise torque, as viewed in FIG. 7A, produced by the weight of the decompression member 80 about the axis L2 of swinging motion and a counterclockwise torque produced by the resilience of the return spring 90 act on the decompression member 80. Since the resilience of the return spring 90 is determined such that the counterclockwise torque is greater than the clockwise torque, the flyweight 81 (or the decompression member 80) is held at the initial position as shown in FIG. 7A, and the decompression cam 82 is received in the upper part 66*b* contiguous with the exhaust cam part of the cut part 66.

The crankshaft 8 is rotated by pulling a starter knob 13*a* (FIG. 1) connected to a rope wound on a reel included in the rewind starter 13 to start the internal combustion engine E. Then, the camshaft 15 rotates at a rotating speed equal to half the rotating speed of the crankshaft 8. The rotating speed of the crankshaft 8, i.e., the engine speed, is not higher than the predetermined engine speed in this state, and hence the decompression member 80 is held at the initial position because the torque produced by centrifugal force acting on the decompression member 80 is lower than the torque produced by the resilience of the return spring 90. When each cylinder bore 2*a* is in a compression stroke, the decompression cam 82 radially projecting from the heel 45*a* of the valve-operating cam 45 comes into contact with the slipper 48*b* to turn the exhaust rocker arm 48 such that the exhaust valve 43 is lifted up by the predetermined decompression lift $L_D$. Consequently, the air-fuel mixture compressed in the cylinder bore 2*a* is discharged through the exhaust port 41, sot the pressure in the cylinder bore 2*a* decreases, the piston 6 is made easily to pass the top dead center, and hence the rewind starter 13 can be operated by a low force.

After the engine speed has exceeded the predetermined engine speed, the torque produced by the centrifugal force acting on the decompression member 80 exceeds the torque produced by the resilience of the return spring 90. If the decompression cam 82 is separated from the slipper 48*b* of the exhaust rocker arm 48, the decompression member 80 starts being turned clockwise, as viewed in FIG. 7A, by the torque produced by the centrifugal force, the arm 83 slides along the bottom surface 66*a*, the decompression member 80 is turned until the same reaches the full-expansion position where the contact protrusion 83*b* of the arm 83 is in contact with the upper surface 52*b*1 of the step 52*b* as shown in FIG. 7B. With the decompression member 80 at the full-expansion position, the decompression cam 82 is separated from the upper part 66*b* contiguous with the exhaust cam part of the cut part 66 in the direction of the arrow A and is separated from the slipper 48*b*, so that the decompressing operation is stopped. Consequently, the slipper 48*b* is in contact with the heel 45*a* of the exhaust cam part 45*e* while the cylinder bore 2*a* is in a compression stroke as indicated by two-dot chain lines in FIG. 3 to compress an air-fuel mixture at a normal compression pressure. Thereafter, the engine speed increases to an idling speed. With the decompression member 80 at the full-expanded position, the center G of gravity of the decompression member 80 is at a distance approximately equal to the distance d2 (FIG. 5) between the axis L2 of swinging motion and the reference plane P3 from the reference plane P3. Since the outer surface 81*c*6 of the weight body 81*c* of the flyweight 81 extends radially inward with distance from the pin 71 downward, the radial expansion of a cylindrical space in which the flyweight 81 revolves is suppressed, and the circumference of the cylindrical space coincides substantially with the cylindrical surface 52*a* having the shape of a circular cylinder of the shaft part 52.

Thus, the mass ratio of the flyweight 81 to the decompressing mechanism D is large because the flyweight 81 is a block and the decompressing mechanism D is provided with the single arm 83. The decompressing mechanism D comprises the component parts respectively having different thicknesses. The width along the direction of the arrow B of the flyweight 81 is greater than the thickness t1 along the direction of the arrow B of the arm 83 extending along the plane P1, the thickness t2 along the radial direction of the flyweight 81 is greater than the thickness along the direction of the arrow B of the arm 83. Thus, most of the mass can be concentrated on the flyweight 81, while the decompressing mechanism D can be formed in a lightweight structure. Since the flyweight 81 is placed in a space radially extending into the camshaft 15 so that the flyweight 81 overlaps the camshaft 15 as viewed from the direction perpendicular to the reference plane P3, the increase of the size of the decompressing mechanism D can be suppressed and, consequently, the space around the camshaft 15 in which the decompressing mechanism D in the full-expanded position revolves can be narrowed and the increase of the space can be suppressed.

The width along the direction of the arrow B of the weight body 81*c* is greater than the thickness 13 of the projections 81*a* and 81*b* and the thickness t1 of the arm 83, and the thickness along the radial direction of the weight body 81*c* is greater than the thickness t3 of the projections 81*a* and 81*b* and the thickness t1 of the arm 83. Therefore, the masses of the projections 81*a* and 81*b* and the arm 83 is reduced to the least possible extent, maintaining necessary rigidity, to concentrate most of the mass of the decompressing mechanism D on the weight body 81*c*.

The sum of the lengths along the direction of the arrow B of the holes 84 of the projections 81*a* and 81*b* is great than the sum of the lengths along the direction of the arrow B of the holes 70 of the projections 68*a* and 68*b* of the camshaft. Therefore, the area of a part, in contact with the projections 81*a* and 81*b*, of the pin 71 is large and hence pressure acting on the contact surfaces is reduced, so that the abrasion of the contact parts of the projections 81*a* and 81*b* and the pin 71 due to the vibration of the internal combustion engine E is reduced.

The end part 71*b* of the pin 71 projecting from the hole 84 of the projection 81*a* on the outer side of the holding part 69 with respect to the direction of the arrow B is pressed to form an expanded part 73, so that the pin 71 is held in the holes 84 and 70. Thus, the pin 71 can be held in place simply by press work.

The arm 83 and the projections 81*a* and 81*b* extend individually from the weight body 81*c*. Therefore, the thicknesses and shapes of the arm 83 and the projections 81*a* and 81*b* can be individually determined and the optimum designing of the positional relation of the flyweight 81 and the arm 83 with the camshaft 15, the projections 81*a* and 81*b*, the weight body 81*c* and the arm 83 is possible. For example, since the projections 81*a* and 81*b*, and the arm 83 can be individually designed, increase in size of the projections 81*a* and 81*b*, supporting only the weight body 81*c* can be suppressed as compared with the lever, which corresponds to the decompression member, of the prior art A in which the part supported on the pin supports the flyweight and the arm. This also contributes to the concentration of the most mass on the weight body 81*c* and to the suppression of the dimensional increase of the flyweight 81, hence the decompression member 80. The projections 81*a* and 81*b* can be easily formed in the thickness t3 greater than the thickness t1 of the arm 83 regardless of the thickness t1 of the arm 83 to increase the area of contact between the projections 81*a* and 81*b* and the pin 71, which is advantageous for reducing the abrasion of the contact part of the flyweight 81 and the pin 71.

The axis L2 of swinging motion of the flyweight 81 of the decompressing mechanism D is included in a plane P4 substantially perpendicular to the axis L1 of rotation of the camshaft 15, is separate radially from the axis L1 of rotation and, preferably, does not intersect the oil passage 63, i.e., the bore 54. Therefore, the bore 54 can be formed in the camshaft 15 provided with the decompressing mechanism D to reduce the weight of the camshaft 15, the diameter of the bore 54 is scarcely limited by the pin 71 held on the camshaft 15, and the bore 54 can be formed in a comparatively big diameter. Consequently, the bore 54 is able to serve as the oil passage 63 capable of passing the lubricating oil sufficient for lubricating the valve mechanism and the decompressing mechanisms D installed in the valve gear chamber 14. If the camshaft 15 having the bore 54 of a comparatively big diameter is formed by casting, a core for forming the bore 54 having a comparatively big diameter can be formed more easily than a core of a small diameter for forming an oil passage of a comparatively small diameter.

Since the axis L2 of swinging motion is separated radially from the axis L1 of rotation and the bore 54 so that the arm 83 extends beyond the axis L1 of rotation as viewed from the direction of the arrow B, i.e., the pin 71 and the decompression cam 82 are on the opposite sides of the reference plane P3, the distance between the axis L2 of swinging motion and the decompression cam 82 is longer as compared with that when the axis L2 of swinging motion intersects the axis L1 of rotation substantially perpendicularly. Therefore, the flyweight 81 needs to turn only through a small angle to stop the decompressing operation. Since the maximum swing angle of the flyweight 81 is small, the cylindrical space around the axis L1 of rotation, in which the fully expanded decompressing mechanism D revolves, can be radially contracted, a comparatively large space does not need to be secured for the decompressing mechanism D around the camshaft 15 and, consequently, the internal combustion engine E can be formed in a comparatively small size. Since the pin 71 and the weight body 81*c* always overlap each other as viewed from the direction of the arrow A in the maximum range of swinging motion, the cylindrical space around the camshaft 15 necessary for the fully expanded decompressing mechanism D to revolve can be contacted.

Since the axis L2 of swinging motion is spaced radially from the axis L1 of rotation, the position of the center of gravity of the flyweight 81 and hence the center G of gravity of the decompression member 80 can be easily spaced far from the reference plane P3. Since the distance between the position of the center G of gravity of the decomposition member 80 and the axis L1 of rotation is thus increased, the weight of the flyweight 81 for generating a necessary centrifugal force can be reduced accordingly, the internal combustion engine G can be formed in lightweight construction, and the radial expansion of the cylindrical space necessary for the revolution of the fully expanded decompression member 80 and the decompressing mechanisms D can be suppressed. Since the arm 83 can be formed in a length such that the arm 83 does not project from the shaft part 52 of the camshaft 15 in a direction perpendicular to the reference plane P3 as viewed from the direction of the arrow B in the maximum range of swinging motion, the decompressing mechanism D can be formed in a small size.

Since the single pin 71 pivotally supporting the flyweight 81 is held by the holding part 69 having the projections 68*a* and 69*b* radially projecting from the camshaft 15, the distance between the axis L2 of swinging motion and the decompression cam 82 is longer than that when the axis L2 of swinging motion is on the shaft part 52 of the camshaft 15, which enables the reduction of the maximum angle of swinging motion and contributes to the radial reduction of the cylindrical space necessary for the fully expanded decompression member 80 to revolve.

The axis L2 of swinging motion is radially spaced from the axis L1 of rotation and the bore 54, the decompression member 80 is provided integrally with the flyweight 81, the decompression cam 82 and the arm 83, the weight body 81*c* of the flyweight 81 and the arm 83 have different thicknesses, respectively, and the weight body 81*c* is a block of a thickness greater than that of the arm 83. Thus, the concentration of the mass on the weight body 81*c* of the flyweight 81 is promoted increase in size of the decompression member 80 can be suppressed, the mass of the flyweight 81 is sufficient for stopping the decompressing operation, the center of gravity of the flyweight 81 can be easily set at a position far from the reference plane P3, and the radial expansion of the cylindrical space necessary for the fully expanded decompression member 80 to revolve can be suppressed.

Load produced by the resilience of the valve spring 44 and placed through the exhaust rocker arm 48 on the decompression cam 82 is born by the bottom surface 66*a*. Thus, the load placed on the arm 83 by the exhaust rocker arm 48 during the decompressing operation can be reduced. Therefore, the thickness t1 of the arm 83 may be small, and the arm 83 can be formed in a small weight. Since the axis L2 of swinging motion does not intersect the axis L1 of rotation and the bore 54, and the flyweight 81 is received in the cut part 67, the enlargement of the weight body 81*c* in a radial direction can be suppressed, the weight body 81*c* can be extended along the axis L2 of swinging motion to a position on the opposite side of the arm 83 with respect to the axis L1 of rotation, and the opposite end parts 81*c*2 and 81*c*3 can be extended nearer to the reference plane P3 than the middle bottom surface 67*a* of the cut part 67, which further facilitates the concentration of the mass on the flyweight 81 of the decompression member 80.

Although the flyweight 81, the decompression cam 82 and the arm 83 have different thicknesses, respectively, the flyweight 81, the decompression cam 82 and the arm 83 can be integrally formed in a high dimensional accuracy by metal injection. Therefore, the difference in operating characteristic between the decompressing mechanisms D is small, and the decompressing mechanisms D capable of stably exercising the operating characteristic can be easily manufactured.

Since the cut part 67 capable of receiving the flyweight 81 therein is formed near the axis L1 of rotation in the camshaft 15, the cylindrical space for the revolution of the fully expanded decompressing mechanism D extends around the axis L1 of rotation of the camshaft 15, a comparatively large space does not need to be secured around the camshaft 15 for the decompressing mechanism D, and the internal combustion engine E can be formed in a small size. Moreover, since the decompressing mechanism D has the contact protrusion 81*c*5 that comes into contact with the camshaft 15 to define the initial position of the flyweight 81 received in the cut part 67, and the return spring 90 for applying a resilient force to the flyweight 81 to press the flyweight 81 toward the initial position, the flyweight 81 is received in the cut part 67 near the axis L1 of rotation. Therefore, the flyweight 81 can be held at the initial position with the contact protrusion 81*c*5 in contact with the camshaft 15 by the resilience of the return sprig 90, can be held stably without being affected by gravity at the initial position, and generation of noise due to collision between the flyweight 81 and the camshaft 15 caused by vibrations can be suppressed regardless of the positional relation of the initial position of the flyweight 81 with the axis L2 of swinging motion while the camshaft 15 is stopped and while the internal combustion engine E is operating at engine speeds in an engine speed range for the decompressing operation.

A depressing mechanism in a modification of the decompressing mechanism D in the foregoing embodiment will be described. Only parts of the decompressing mechanism in the modification different from those of the decompressing mechanism D in the foregoing embodiment will be described.

In the foregoing embodiment, the pin 71 is inserted slidably in the holes 70 of the holding part 69. The pin 71 may be slidably inserted in the holes 84 and may be fixedly pressed in the holes 70, and the flyweight 81 (or the decompression member 80) may be swingably supported on the pin 71. The flyweight 81 can be pivotally supported by the pin 71 on the camshaft 15 provided with the bore 54, and most of in developed in the camshaft 15 by the combination of the pin 71 with the camshaft 15 by press fitting can be absorbed by the holding part 69 including the projections 68*a* and 68*b* projecting radially outward from the camshaft by pressing the pin 71 supporting the flyweight 81 in the holding part 69 including the projections 68*a* and 68*b* projecting radially outward from the camshaft 15. Consequently, the deformation of the camshaft 15 and that of the cam surface 45*s* of the valve-operating cam can be suppressed, the abrasion of the sliding parts of the camshaft 15 and the valve-operating cam 45 attributable to such deformations can be reduced, and the durability of the camshaft 15 and the valve-operating cam 45 can be improved.

Although the decompression member 80 of the decompressing mechanism D of the foregoing embodiment is a single member integrally including fictional parts, the decompressing mechanism D may include individual members including a flyweight, a decompression cam and an arm, at least one of those members may be a different member, and the flyweight, the decompression cam and the arm may be joined together by fixing means. The holding part 69 may include a single projection instead of the pair of projections 68*a* and 69*b*. The decompression member 80 integrally including the component parts may be formed by any suitable forming means other than metal injection.

Although the intake valve 42 and the exhaust valve 43 are operated for opening and closing by the single, common valve-operating cam 45 in do foregoing embodiment, the intake valve 42 and the exhaust valve 43 may be controlled by a valve-operating cam specially for operating the intake valve 42 and a valve-operating cam specially for operating the eat valve 43, respectively. The intake valve 42 may be operated by the decompressing mechanism D instead of the exhaust valve 43.

Although the center a of gravity of the decompression member 80 is nearer to the reference plane P3 than the axis L2 of swinging motion and the decompression member 80 is held at the initial position by the return spring 90 in the foregoing embodiment, the center G of gravity of the decompression member 80 may be farther from reference plane P3 than the axis L2 of swinging motion, the decompression member 80 may be held at the initial position by a torque produced by its own weight, and the return spring 90 may be omitted.

Although the projections 81*a* and 81*b* of the flyweight 81 are on the outer side of the holding part 69 of the camshaft 15 with respect to the direction of the arrow B in the foregoing embodiment, the projections 81*a* and 81*b* of the flyweight 81 may be on the inner side of the holding part 69 of the camshaft 15 with respect to the direction of the arrow B. If the projections 81*a* and 81*b* of the flyweight 81 are on the inner side of the holding part 69 of the camshaft 15 with respect to the direction of the arrow B, the expanded part 73 is formed by pressing the end part 71*b*, projecting from the hole 70 of the holding part 69, of the pin 71, and the flyweight 81 may be provided with a single projection instead of the two projections 81*a* and 81*b*.

Although the camshaft 15 is provided with the oil passage 63 in the foregoing embodiment, a hollow camshaft having a bore 54 not serving as an oil passage may be used. The present invention is applicable also to a horizontal internal combustion engine having a crankshaft having a horizontal axis of rotation. The present invention is applicable not only to the internal combustion engine for the outboard motor, but also for general-purpose internal combustion engines for driving generators, compressors, pumps and such, and those for vehicles. The present invention is applicable to single-cylinder internal combustion engines and multiple cylinder internal combustion engines provided with three or more cylinders.

Although the internal combustion engine in the foregoing embodiment is a spark-ignition engine, the internal combustion engine may be a compression-ignition engine. The starting device may be any suitable starting device other than the rewind starter, such as a kick starter, a manual starter or a starter motor.

Although the axis L2 of swinging motion is at a distance greater than the radius R of the shaft part 52 from the reference plane P3 in the foregoing embodiment, the distance may be shorter than the radius R.

Although the camshaft 15 is provided with the bore 54 in the foregoing embodiment, the cam shaft 15 need not necessarily be provided with the bore 54. The pin 71 may be held on the camshaft 15 so that the axis L2 of swinging motion is perpendicular to the axis L1 of rotation whether or not the camshaft 15 is provided with the bore 54. In such a case, the reference plane P3 includes both the axis L1 of rotation and the axis 12 of swinging motion. Although the arm 83 is connected to the weight body 81*c* of the flyweight in the foregoing embodiment, the arm 83 may be connected to either the projection 81*a* or the projection 81*b*.

What is claimed is:

1. An internal combustion engine comprising: a crankshaft; a camshaft driven for rotation in synchronism with the crankshaft a valve-operating cam formed on the camshaft; engine valves operated for opening and closing by the valve-operating cam; and a decompressing mechanism which opens the engine valve in a compression stroke in a starting phase;

wherein the decompressing mechanism comprises a flyweight supported for swinging motion by a pin on the camshaft, a decompression cam that operates together with the flyweight to exert a valve-operating force on one of the engine valves, and an arm connecting the flyweight and the decompression cam, said decompression cam having a contact surface facing the cam shaft and slidingly guided by a guide surface formed on the cam shaft when the flyweight undergoes the swinging motion together with the decompression cam, and a cam lobe for exerting force on one of said engine valves, said cam lobe being formed on the decompression cam at the opposite side of the guide surface to protrude in a direction parallel to said axis of swing motion, the flyweight has a weight body and projections projecting from the weight body and engaged with the pin, the pin is disposed such that an axis of swinging motion of the flyweight is included in a plane substantially perpendicular to an axis of rotation of the camshaft, the weight body is a block of a width along the axis of swinging motion and a thickness along a radial direction which are greater than a thickness along the axis of swinging motion of the arm, the weight body overlaps the camshaft as viewed from a direction perpendicular to a reference plane including the axis of rotation of the camshaft and parallel to the axis of swing motion.

2. The internal combustion engine according to claim 1, wherein the arm has the shape of a plate, and the thickness of the arm is equal to a thickness of the plate.

3. The internal combustion engine according to claim 1, wherein the arm is extended from the flyweight in a plane perpendicular to the axis of swinging motion.

4. An internal combustion engine comprising: a crankshaft; a camshaft driven for rotation in synchronism with the crankshaft; a valve-operating cam formed on the camshaft; engine valves operated for opening and closing by the valve-operating cam; and a decompressing mechanism which opens the engine valve in a compression stoke in a starting phase;

wherein the decompression mechanism comprises a flyweight supported for swinging motion by a pin on the camshaft, a decompression cam that operates together with the flyweight to exert a valve-operating force on one of the engine valves, and an arm connecting the flyweight and the decompression cam, the flyweight has a weight body and projections projecting from the weight body and engaged with the pin, the pin is disposed such that an axis of swinging motion of the flyweight is included in a plane substantially perpendicular to an axis of rotation of the camshaft, the weight body is a block of a width along the axis of swinging motion and a thickness along a radial direction which are greater than a thickness along the axis of swing motion of the arm, and the weight body overlaps the camshaft as viewed from a direction perpendicular to a reference plane including the axis of rotation of the camshaft and parallel to the axis of swing motion; and wherein the camshaft has a holding part provided with first holes, the projections of the flyweight are provided with second holes, respectively, the pin is inserted in the first holes so as to be turnable therein and is inserted in the second holes to support the flyweight for turning, an end part of the pin projecting outside from one of the first holes or the second holes is pressed to form an expanded part to prevent the pin from coming off the first holes and the second holes.

5. The internal combustion engine according to claim 1, wherein the arm is extended from the weight body.

6. The internal combustion engine according to claim 1, wherein the flyweight, the decompression cam and the arm are formed integrally in a single structure by metal injection.

7. An internal combustion engine comprising: a crankshaft; a camshaft driven for rotation in synchronism with the crankshaft; a valve-operating cam formed on the camshaft; engine valves operated for operating and closing by the valve-operating cam; and a decompressing mechanism which opens the engine valve in a compression stroke in a starting phase;

wherein the decompressing mechanism comprises a flyweight supported for swinging motion by a pin on the camshaft, a decompression cam that operates together with the flyweight to exert a valve-opening force on one of the engine valves, and an arm connecting the flyweight and the decompression cam, the flyweight has a weight body and projections projecting from the weight body and engaged with the pin, the pin is disposed such that an axis of swinging motion of the flyweight is included in a plane substantially perpendicular to an axis of rotation of the camshaft, the weight body is a block of a width along the axis of swinging motion and a thickness along a radial direction which are greater than a thickness along the axis of swinging motion of the arm, and the weight body overlaps the camshaft as viewed from a direction perpendicular to a reference plane including the axis of rotation of the camshaft and parallel to the axis of swing motion; and wherein the crankshaft has a vertical axis of rotation, a cut part for receiving the flyweight therein is formed in an outer surface of the camshaft, and the decompressing mechanism includes a return spring that exerts resilient force on the flyweight received in the cut part to hold the flyweight at an initial position.

8. The internal combustion engine according to claim 7, wherein a second cut for receiving the arm connecting the flyweight and the decompression cam, and the decompression cam therein is formed in the outer surface of the camshaft, and the arm has a contact protrusion that rests on the camshaft to locate the flyweight at a full-expansion position.

9. The internal combustion engine according to claim 8, wherein the second cut part has a step with which the contact protrusion comes into contact.

10. The internal combustion engine according to claim 8, wherein the second cut part has a bottom surface along which the arm slides when the flyweight swings.

11. The internal combustion engine according to claim 1, wherein the flyweight, the decompression cam and the arm are formed integrally as a single unitary member.

12. An internal combustion engine comprising: a crankshaft; a camshaft driven for rotation in synchronism with the crankshaft; a vale-operating cam formed on the camshaft; an engine valve operated for opening and closing by the valve-operating cam; and a decompressing mechanism which opens the engine valve in a compression stroke in a staring phase;

wherein the decompressing mechanism comprises a pin supported on the camshaft at a distance from the axis of rotation of the cam shaft which is greater than a radius of a shaft part of the camshaft, said pin having an axis included in a plane substantially perpendicular to an axis of rotation of the camshaft, a flyweight supported by the pin for swinging motion around the axis of the pin, a decompression cam connected to the flyweight to operate together with the flyweight to exert a valve-opening force on the engine valve, and an arm connecting the flyweight and the decompression cam, said decompression cam having a contact surface facing the earn shaft and slidingly guided by a guide surface formed on the cam shaft when the flyweight undergoes the swinging motion together with the decompression cam, and a cam lobe for exerting force on one of said engine valves, said cam lobe being formed on the decompression cam at the opposite side of the guide surface to protrude in a direction parallel to said axis of swing motion; and wherein the flyweight has a weight body and projections projecting from the weight body and engaged with the pin, the weight body is a block of a width along said axis of the pin and a thickness in a radial direction of the camshaft, said width and said thickness being greater than a thickness of the arm along the axis of the pin, and the weight body overlaps the camshaft as viewed in a direction perpendicular to a reference plane which includes the axis of rotation of the camshaft and is parallel to said axis of the pin.

13. An internal combustion engine comprising: a crankshaft; a camshaft driven for rotation in synchronism with the crankshaft: a valve-operating cam formed on the camshaft; an engine valve operated for opening and closing by the valve-operating cam; and a decompressing mechanism which opens the engine valve in a compression stroke in a starting phase;

wherein the decompressing mechanism comprises a pin supported on the camshaft at a distance from the axis of rotation of the cam shaft which is greater than a radius of a shaft part of the camshaft, said pin having an axis included in a plane substantially perpendicular to an axis of rotation of the camshaft, a flyweight supported by the pin for swinging motion around the axis of the pin, a decompression cam connected to the flyweight to operate together with the flyweight to exert a valve-opening force on the engine valve, and an arm connecting the flyweight and the decompression cam;

wherein the flyweight has a weight body and projections projecting from the weight body and engaged with the pin, the weight body is a block of a width along said axis of the pin and a thickness in a radial direction of the camshaft, said width and said thickness being greater than a thickness of the arm along the axis of ft pin, and the weight body overlaps the camshaft as viewed in a direction perpendicular to a reference plane which includes the axis of rotation of the camshaft and is parallel to said axis of the pin, and wherein said pin is supported on projections protruding outward from the camshaft.

14. The internal combustion engine according to claim 13, wherein said projections of the flyweight are in adjoining relation with said projections of the pin with respect to the direction of said axis of the pin.

15. The internal combustion engine according to claim 12, wherein the arm has the shape of a plate, and the thickness of the arm is equal to a thickness of the plate.

16. The internal combustion engine according to claim 12, wherein the arm is extended from the flyweight in a plane perpendicular to the axis of the pin.

17. An internal combustion engine comprising: a crankshaft; a camshaft driven for rotation in synchronism with the crankshaft; a valve-operating cam formed op the camshaft; an engine valve operated for opening and closing by the valve-operating cam; and a decompressing mechanism which opens the engine valve in a compression stroke in a starting phase;

wherein the decompressing mechanism comprises a pin supported on the camshaft at a distance from the axis of the rotation of the cam shaft which is greater than a radius of a shaft part of the camshaft, said pin having an axis included in a plane substantially perpendicular to an axis of rotation of the camshaft, a flyweight supported by the pin for swinging motion around the axis of the pin, a decompression cam connected to the flyweight to operate together with the flyweight to exert a valve opening force on the engine valve, and an arm connecting the flyweight and the decompression cam;

wherein the flyweight has a weight body and projections projecting from the weight body and engaged with the pin, the weight body is a block of a width along said axis of the pin and a thickness in a radial direction of the camshaft, said width and said thickness being greater than a thickness of the arm alone the axis of the pin, and the weight body overlaps the camshaft as viewed in a direction perpendicular to a reference plane which includes the axis of rotation of the camshaft and is parallel to said axis of the pin, and wherein the camshaft has a holding part provided with first holes, the projections of the flyweight are provided with second holes, respectively, the pin is inserted in the first holes so as to be turnable therein and is inserted in the second holes to support the flyweight for turning, an end part of the pin projecting outside from one of the first holes or the second holes is pressed to form an expanded part to prevent the pin from coming off the first holes and the second holes.

18. The internal combustion engine according to claim 12, wherein the arm is extended from the weight body.

19. The internal combustion engine according to claim 12, wherein the flyweight, the decompression cam and the arm are formed integrally in a single structure by metal injection.

20. An internal combustion engine comprising: a crankshaft; a camshaft driven for rotation in synchronism with the crankshaft; a valve-operating cam formed on the camshaft; an engine valve operated for opening and closing by the valve-operating cam; and a decompressing mechanism which opens the engine valve in a compression stroke in a starting phase;

wherein the decompressing mechanism comprises a pin supported on the camshaft at a distance from the axis of rotation of the cam shaft which is greater than a radius of a shaft part of the camshaft, said pin having an axis included in a plane substantially perpendicular to an axis of rotation of the camshaft, a flyweight supported by the pin for swinging motion around the axis of the pin, a decompression cam connected to the flyweight to operate together with the flyweight to exert a valve-opening force on the engine valve, and an arm connecting the flyweight and the decompression cam;

wherein the flyweight has a weight body and projections projecting from the weight body and engaged with the pin, the weight body is a block of a width along said axis of the pin and a thickness in a radial direction of the camshaft, said width and said thickness being greater than a thickness of the arm along the axis of the pin, and the weight bode overlaps the camshaft as viewed in a direction perpendicular to a reference plane which includes the axis of rotation of the camshaft and is parallel to said axis of the pin, and wherein the crankshaft has a vertical axis of rotation, a cut part for receiving the flyweight therein is formed in an outer surface of the camshaft, and the decompressing mechanism includes a return spring that exerts resilient force on the flyweight received in the cut part to hold the flyweight at an initial position.

21. The internal combustion engine according to claim 20, wherein a second cut for receiving the arm connecting the flyweight and the decompression cam, and the decompression cam therein is formed in the outer surface of the cha and the arm has a contact protrusion that rests on the camshaft to locate the flyweight at a full-expansion position.

22. The internal combustion engine according to claim 21, wherein the second cut part has a step with which the contact protrusion comes into contact.

23. The internal combustion engine according to claim 21, wherein the second cut part has a bottom surface along which the arm slides when the flyweight swings.

24. An internal combustion engine comprising: a crankshaft; a camshaft driven for rotation in synchronism with the crankshaft; a valve-operating cam formed on the camshaft; engine valves operated for opening and closing by the valve-operating cam; and a decompressing mechanism which opens the engine valve in a compression stroke in a starting phase;

wherein the decompressing mechanism comprises a flyweight supported for swinging motion by a pin on the camshaft, a decompression cam that operates together with the flyweight to exert a valve-opening force on one of the engine valves, and an arm connecting the flyweight and the decompression cam, the flyweight has a weight body and projections projecting from the weight body and engaged with the pin, the pin is disposed such that an axis of swinging motion of the flyweight is included in a plane substantially perpendicular to an axis of rotation of the camshaft, the weight body is a block of a width along the axis of swinging motion and a thickness along a radial direction which are greater than a thickness alone the axis of swinging motion of the arm, and the weight body overlaps the camshaft as viewed from a direction perpendicular to a reference plane including the axis of rotation of the camshaft and parallel to the axis of swing motion, and wherein said arm projects from said weight body of the flyweight separately from said projections.

25. An internal combustion engine comprising: a crankshaft; camshaft driven for rotation in synchronism with the crankshaft; a valve-operating cam formed on the camshaft; engine valves operated for opening and closing by the valve-operating cam; and a decompressing mechanism which opens the engine valve in a compression stroke in a starting phase;

wherein the decompressing mechanism comprises a flyweight supported for swinging motion by a pin on the camshaft, a decompressing cam that operates together with the flyweight to exert a valve-opening force on one of the engine valves, and an arm connecting the flyweight and the decompression cam, the flyweight has a weight body and projections projecting from the weight body and engaged with the pin, the pin is disposed such that an axis of swinging motion of the flyweight is included in a plane substantially perpendicular to an axis of rotation of the camshaft, the weight body is a block of a width along the axis of swinging motion and a thickness along a radial direction which are greater than a thickness along the axis of swinging motion of the arm, and the weight body overlaps the camshaft as viewed from a direction perpendicular to a reference plane including the axis of rotation of the camshaft and parallel to the axis of swing motion, and wherein the flyweight, is at least partially disposed in a recess formed in said camshaft.

26. The internal combustion engine according to claim 1, wherein the flyweight and the decompression cam are disposed such that both the flyweight and the decompression cam reside on a first side of the pin.

* * * * *

UNITED STATES PATENT AND TRADEMARK OFFICE

CERTIFICATE OF CORRECTION

PATENT NO. : 6,857,408 B2 
DATED : February 22, 2005
INVENTOR(S) : Hiroyuki Yoshida, Tomonori Ikuma and Mitsuhara Tanaka It is certified that error appears in the above-identified patent and that said Letters Patent is hereby corrected as shown below:

Column 3,
Line 21, change "the flyweight for tog" to -- the flyweight for turning --.
Line 21, change "and an end pant projecting" to -- and an end part projecting --.

Column 5,
Line 20, change "by the crankshaft a through a transmission" to -- by the crankshaft 8 through a transmission --.
Line 53, change "Tec mounting frame 36" to -- "The mounting frame 36 --.

Column 6,
Line 17, change "the exhaust cam part 45c" to -- the exhaust cam part 45e --.
Line 26, change "part 45c of the valve-operating cam 45" to -- part 45e of the valve-operating cam 45 --.

Column 7,
Line 9, change "the branch oil passages ate" to -- the branch oil passages are --.
Line 19, change "outer rotor 18e through the oil strainer 58" to -- outer rotor 18c through the oil strainer 58 --
Line 65, change "starting the internal combustion engine A" to -- starting the internal combustion E --

Column 8,
Line 13, change "contact with the slipper 49b" to -- contact with the slipper 48b --
Line 38 change " the axis L1 of the rotation and parallel to the axis 12" to
-- the axis L1 of rotation and parallel to the axis L2 --.

Column 9,
Line 36, change "the projections 81a and 81b of the pin 71 is" to -- the projections 81 and 81b is --.
Line 46, change "provided with a bead 71a" to -- provided with a head 71a --.
Line 57, change "past 69" to -- part 69 --.
Line 59, change "(Figs. 7A and 7B)" to -- (Fig. 7A and 7B) --.

Column 12,
Line 32, change "exhaust port 41, sot the pressure" to -- exhaust port 41, so that the pressure --.

UNITED STATES PATENT AND TRADEMARK OFFICE

CERTIFICATE OF CORRECTION

PATENT NO. : 6,857,408 B2 
DATED : February 22, 2005
INVENTOR(S) : Hiroyuki Yoshida, Tomonori Ikuma and Mitsuhara Tanaka It is certified that error appears in the above-identified patent and that said Letters Patent is hereby corrected as shown below:

Column 13,
Line 13, change "the thickness along the direction" to -- the thickness t1 along the direction --.
Line 27, change "81c is greater than the thickness 13 of the projections" to -- 81c is greater than the thickness t3 of the projections --.

Column 16,
Line 7, change "sprig 90" to -- spring 90 --.
Line 58, change "valve-operating cam 45 in do foregoing" to -- valve-operating cam 45 in the foregoing --.

Column 20,
Line 20, change "the arm along the axis of ft" to -- the arm along the axis of the --.
Line 61, change "A valve-operating cam formed op the camshaft" to -- A valve-operating cam formed on the camshaft --.

Column 21,
Line 8, change "a valve opening force on the engine valve" to -- a valve-opening force on the engine valve --.

Column 22,
Line 2, change "the outer surface of the cha" to -- the outer surface of the camshaft --.
Line 30, change "a thickness alone the axis of swinging" to -- a thickness along the axis of swinging --.

Signed and Sealed this

Nineteenth Day of July, 2005

JON W. DUDAS
*Director of the United States Patent and Trademark Office*